United States Patent [19]

Mechlenburg

[11] Patent Number: 4,689,548

[45] Date of Patent: Aug. 25, 1987

[54] PHASE CONTROLLED REGULATOR

[75] Inventor: Douglas M. Mechlenburg, Erie, Pa.

[73] Assignee: American Sterilizer Company, Erie, Pa.

[21] Appl. No.: 851,850

[22] Filed: Apr. 14, 1986

[51] Int. Cl.[4] ..... G05F 1/455

[52] U.S. Cl. ..... 323/243; 323/300

[58] Field of Search ..... 323/243, 288, 300, 241, 323/242, 908; 315/DIG. 5, DIG. 7

[56] References Cited

U.S. PATENT DOCUMENTS

| | | | |
|---|---|---|---|
| 3,519,917 | 7/1970 | Martin | 323/300 |
| 3,621,373 | 11/1971 | Mitchell et al. | 323/243 X |
| 3,684,947 | 12/1972 | Evalds et al. | 323/242 |
| 3,818,320 | 6/1974 | Schindler | 323/242 |
| 4,004,214 | 1/1977 | Evans | 323/300 |
| 4,160,945 | 7/1979 | Schorr | 323/288 |
| 4,346,339 | 8/1982 | Lewandowski | 323/300 X |
| 4,516,054 | 5/1985 | Shikama et al. | 323/908 X |
| 4,593,232 | 6/1986 | McEdwards | 323/243 X |

*Primary Examiner*—Patrick R. Salce
*Assistant Examiner*—Marc S. Hoff
*Attorney, Agent, or Firm*—Robert D. Yeager; Edward L. Pencoske

[57] ABSTRACT

A phase controlled regulator for selectively connecting a load to an AC source voltage such that substantially constant power is delivered to the load despite fluctuations in the magnitude of the source voltage is comprised of a circuit for detecting the zero crossings of the AC source voltage. A circuit produces a reference signal representative of a periodically increasing value in response to the zero crossings of the AC source voltage. A sensor produces a first signal representative of the instantaneous value of the AC source voltage. A comparator compares the reference signal with the first signal and produces an output signal when a predetermined relationship exists therebetween. A switch is responsive to the output signal for selectively connecting the load to the AC source voltage.

18 Claims, 4 Drawing Figures

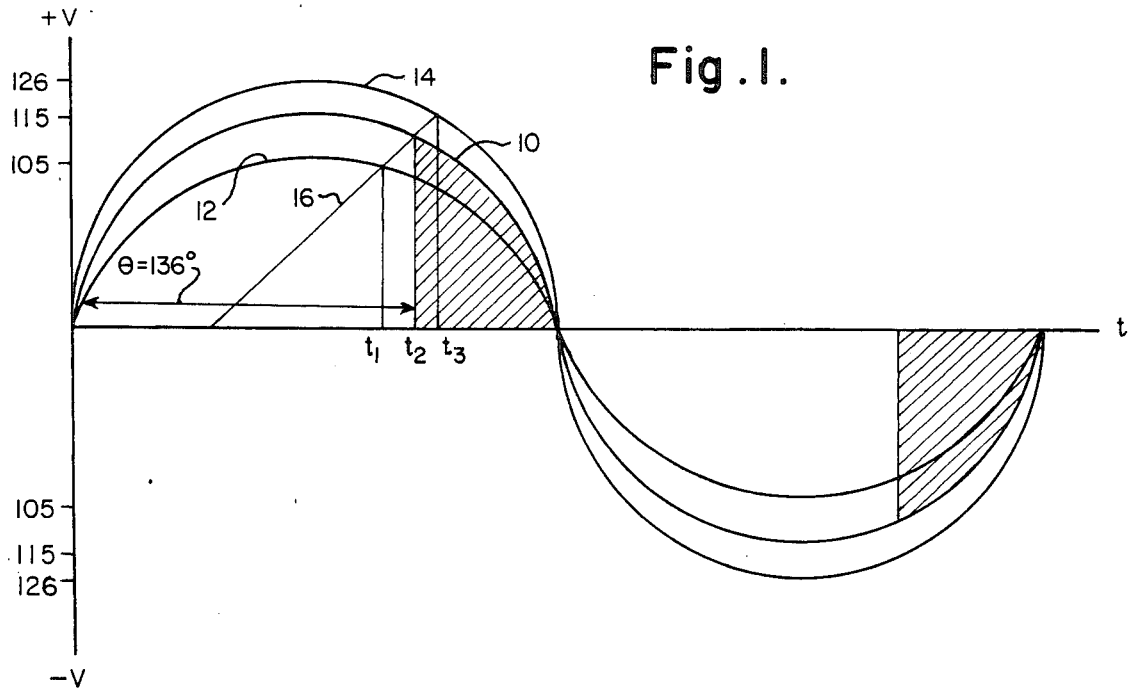
Fig. 1.
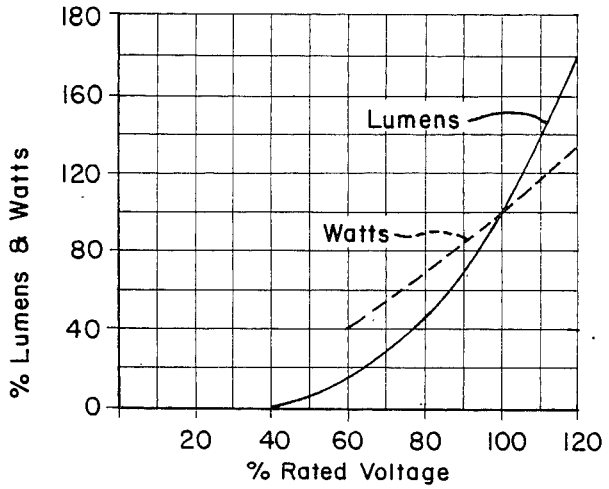
Fig. 2.
Fig. 3.
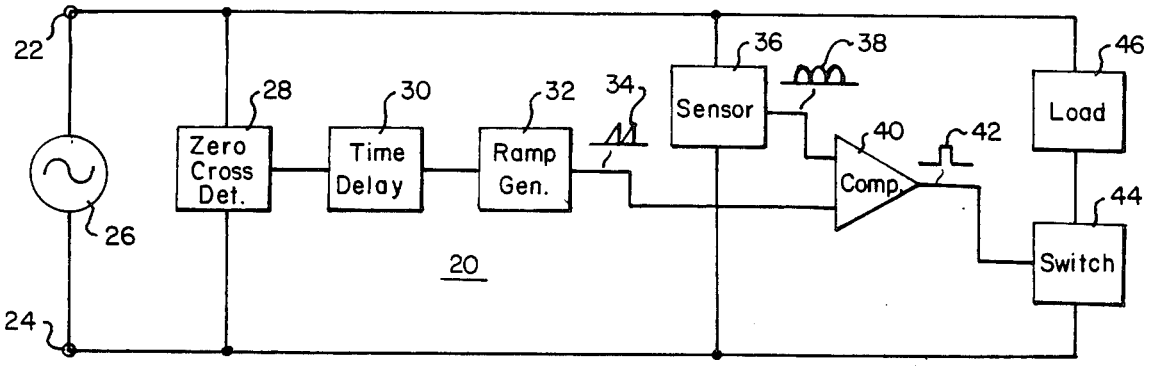

PHASE CONTROLLED REGULATOR

BACKGROUND OF THE INVENTION

The present invention is directed generally to power control systems and more particularly to phase controlled regulators.

The concept of phase controlled regulation is well known in the art. For example, in U.S. Pat. No. 4,086,526 to Grudelbach a method of and a power switching device for regulating the electrical power delivered to a consumer in an AC network is disclosed. The method includes turning a switching device on at the beginning of each half-wave of the line voltage substantially at a phase angle of zero degrees and turning the power switching device off at a phase angle corresponding to the desired current flow angle.

It is known, however, that AC line voltages fluctuate over time. Various prior art phase controlled regulators which merely connect and disconnect a load to line voltage in response to the phase angle do not compensate for these voltage fluctuations. Therefore, when the voltage is higher than nominal line voltage more power is delivered to the load and when the voltage is lower than nominal line voltage less power is delivered to the load. In numerous applications, this variation in delivered power is not important. However, in certain applications such as where the load includes a lamp, it is known that even small variations in delivered power result in large variations in illumination intensity. Therefore, in certain applications it is desirable to not only connect and disconnect the load to line voltage in response to phase angle information, but it is also important to control the amount of power delivered to the load such that it remains constant.

In U.S. Pat. No. 4,004,214 to Evans a phase controlled voltage regulator is disclosed which delivers substantially constant RMS output voltage to a load from a line voltage which may fluctuate. The Evans patent discloses a timing circuit for operating a switch such as a triac. The timing circuit is responsive to a zero crossing detector. The timing circuit times out a predetermined time period based on the zero crossings of the AC line voltage before rendering the triac conductive. A nonlinear function generator is responsive to the fluctuations in the line voltage. The timing circuit is also responsive to the nonlinear function generator such that the predetermined time period is adjusted based on the magnitude of the line voltage. In this manner, the firing of the triac may be controlled such that substantially constant RMS output voltage is delivered to the load.

Despite the availability of circuits such as that disclosed in the Evans patent, it remains desirable to provide phase controlled regulators which are comprised of a minimum number of low cost components. Lower component counts result in ease of manufacturing, especially using mass production techniques, as well as lower costs to the consumer. Additionally, by using a minimum number of components the overall circuitry can be simplified thus leading to greater reliability.

BRIEF DESCRIPTION OF THE PRESENT INVENTION

The present invention is directed to a low cost phase controlled regulator comprised of a minimum number of inexpensive readily available components. The phase controlled regulator of the present invention selectively connects a load to an AC source voltage such that substantially constant power is delivered to the load despite fluctuations in the magnitude of the source voltage. The regulator is comprised of a circuit for detecting the zero crossings of the AC source voltage. A circuit produces a reference signal which is representative of a periodically increasing value in response to the zero crossings of the AC source voltage. A sensor produces a first signal representative of the instantaneous value of the AC source voltage. A comparator compares the reference signal with the first signal and produces an output signal when a predetermined relationship exists therebetween. A switch is responsive to the output signal for selectively connecting the load to the AC source voltage.

One aspect of the present invention includes the use of a sawtooth waveform having substantially linearly increasing ramp portions as the reference signal. The output signal is produced when the magnitude of the ramp portion equals the magnitude of the first signal. Thus, the output signal is produced sooner when the magnitude of the AC source voltage is lower than normal and is produced later when the magnitude of the AC source voltage is higher than normal.

According to another aspect of the present invention the production of the ramp portion of the sawtooth waveform is delayed a predetermined period of time from the zero crossing of the AC source voltage. The length of the predetermined time period is related to the RMS power which is to be delivered to the load.

The present invention is also directed to a method of selectively connecting a load to an AC source voltage such that substantially constant RMS power is delivered to the load despite fluctuations in the magnitude of the source voltage. The method is comprised of the steps of detecting the zero crossings of the AC source voltage. A reference signal representative of a periodically increasing value is produced in response to the zero crossings of the AC source voltage. A first signal representative of the instantaneous value of the AC source voltage is produced. The reference signal is compared to the first signal and an output signal is produced in response to the existence of a predetermined relationship therebetween. The load is selectively connected to the AC source voltage in response to the output signal such that the RMS power delivered to the load remains substantially constant.

The phase controlled regulator of the present invention can be constructed of a minimal number of inexpensive commercially available components. Because of this, the phase controlled regulator of the present invention is easily adapted to mass production techniques and can be produced at a low cost. Additionally, because of the reduced component count, reliability of the present invention is improved. These and other advantages and benefits of the present invention will become apparent from the description of a preferred embodiment hereinbelow.

BRIEF DESCRIPTION OF THE DRAWINGS

In order that the present invention may be clearly understood and readily practiced, a preferred embodiment will now be described, by way of example only, with reference to the accompanying figures wherein:

FIG. 1 is a graph of sine waves of various magnitudes useful in explaining the operation of the present invention;

FIG. 2 is a graph illustrating the variation in lighting intensity as a function of rated voltage;

FIG. 3 is a block diagram illustrating a phase controlled regulator constructed according to the teachings of the present invention.

DESCRIPTION OF A PREFERRED EMBODIMENT

I. Theory of Operation

Figure 4:
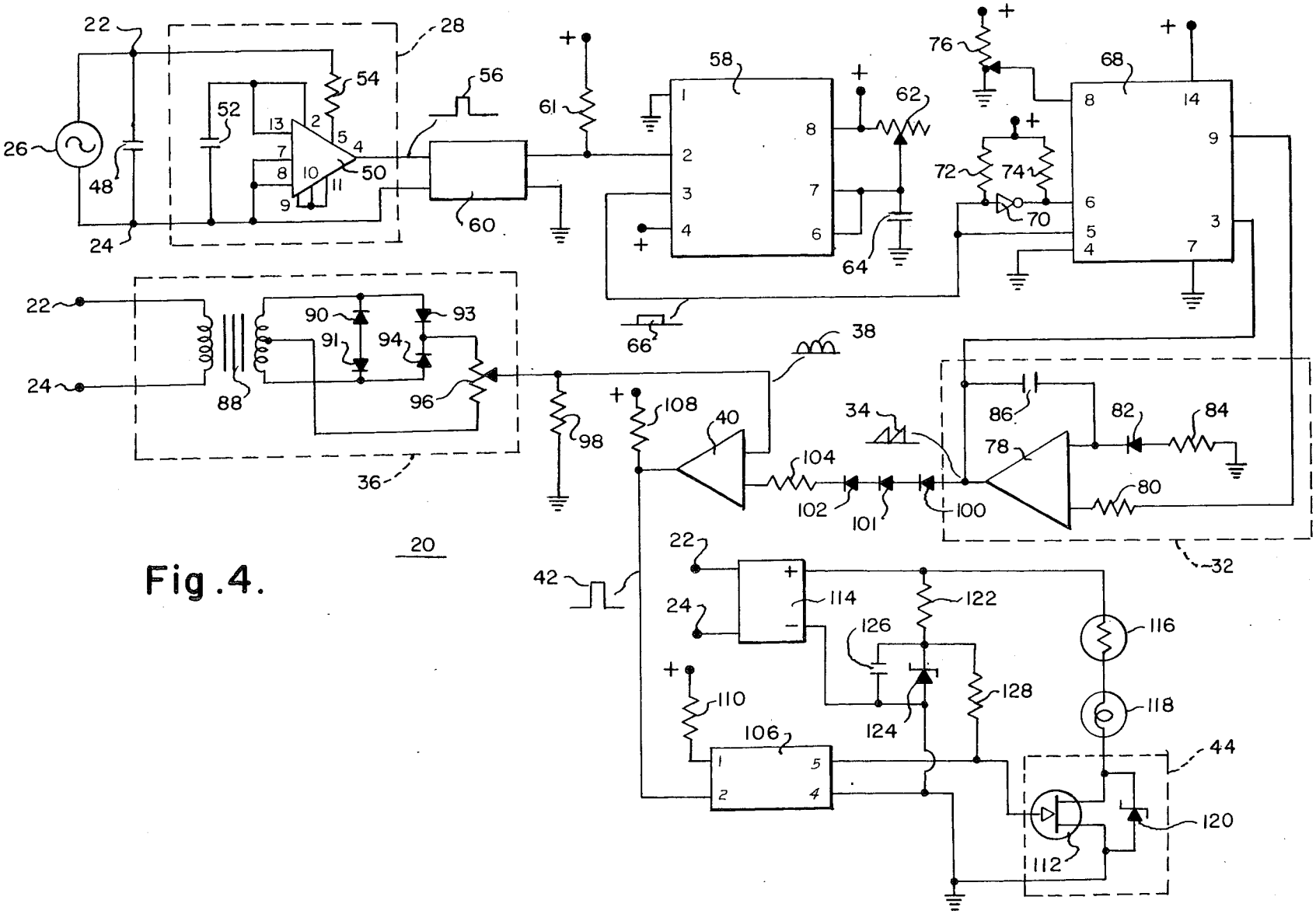
FIG. 4 is an electrical schematic for the phase controlled regulator shown in FIG. 3.

One of the techniques used to step-down line voltage to a level appropriate for a load is to use a silicon controlled rectifier or triac to transmit power to the load for only a selected interval during each half-cycle of the AC source voltage. An illustration of this concept is shown in FIG. 1. The effective voltage of the shaded portion of a waveform 10 of nominal voltage is determined by solving for the square root of the integral of the squares of the instantaneous amplitudes for one complete cycle. This can be represented mathematically as follows:

$$Vrms = \sqrt{\frac{1}{T} \int_{O}^{T} V^2 dt} \quad (1)$$

Solving equation (1) for the effective voltage of the shaded segments shown in FIG. 1 yields a value of 33 volts for Vrms. In general, $$Vrms = \text{Vmax} \cdot \sqrt{N} \cdot \sqrt{\frac{1}{2\pi} \cdot \left(\frac{\theta}{2} - \frac{\sin\theta \cdot \cos\theta}{2}\right)\Bigg|_{\theta 2}^{\theta 1}} \quad (2)$$

In equation (2), N is the number of similar segments being used during each cycle of the AC source voltage.

If the turn-on phase angle is held fixed, and the AC source voltage amplitude fluctuates as is common, the effective voltage of the segments changes accordingly. For example, if the AC source voltage drops to 105 volts as illustrated by sine wave 12 in FIG. 1, the effective voltage of the segments is reduced to 30.1 volts for Vrms. Similarly, if the AC source voltage increases to 126 volts as represented by sine wave 14, the effective voltage of the segments is increased to 36.2 volts for Vrms. From FIG. 2, which is a graph illustrating the variation in lighting intensity as a function of rated voltage, it can be determined that these variations result in corresponding changes in lamp intensity of from minus thirty percent to plus twenty-five percent. Clearly, such intensity variations are unacceptable.

To develop a cost-effective method of regulating the effective voltage applied to a voltage sensitive load such as a lamp, an analysis was completed to determine how the turn-on time, or phase angle, should vary to compensate for fluctuations in the AC source voltage. A calculation was made to determine the variation in turn-on time required to maintain a constant effective voltage of 33 volts as the AC source voltage varied from 105 to 126 volts. The results of these calculations are illustrated in FIG. 1. When the AC source voltage is 105 volts, the turn-on times, it was calculated to be 6.19. For nominal line voltage of 115 volts, the turn-on time t2 was calculated to be 6.32. For an AC source voltage of 126 volts the turn-on time t3 was calculated to be 6.45 volts. Upon plotting these three turn-on times, it was discovered that the locus of turn-on times approximated a straight line 16 illustrated in FIG. 1. An equation was derived representing the closest fit approximation of the locus of turn-on times. Table 1 lists the theoretically exact turn-on times (in milliseconds measured from the zero crossings of the AC source voltage) and the times calculated using the straight line approximation. It can be determined from this data that within the region of interest (105–126 volts) a linear approximation is valid.

TABLE 1

| Theoretically Exact | Straight-Line Approx. | AC Source Voltage | Experimental Results |
|---|---|---|---|
| 6.1847 | 6.1914 | 105 | 6.20 |
| 6.1926 | 6.1976 | 105.5 | — |
| 6.1980 | 6.2070 | 106 | — |
| 6.2059 | 6.2130 | 106.5 | — |
| 6.2139 | 6.2190 | 107 | — |
| 6.2218 | 6.2248 | 107.5 | — |
| 6.2271 | 6.2337 | 108 | — |
| 6.2351 | 6.2393 | 108.5 | — |
| 6.2430 | 6.2448 | 109 | — |
| 6.2484 | 6.2535 | 109.5 | — |
| 6.2563 | 6.2588 | 110 | 6.25 |
| 6.2616 | 6.2673 | 110.5 | — |
| 6.2696 | 6.2723 | 111 | — |
| 6.2749 | 6.2807 | 111.5 | — |
| 6.2828 | 6.2855 | 112 | — |
| 6.2881 | 6.2937 | 112.5 | — |
| 6.2961 | 6.2983 | 113 | — |
| 6.3014 | 6.3063 | 113.5 | — |
| 6.3094 | 6.3016 | 114 | — |
| 6.3147 | 6.3185 | 114.5 | — |
| 6.3226 | 6.3226 | 115 | 6.30 |
| 6.3279 | 6.3303 | 115.5 | — |
| 6.3332 | 6.3379 | 116 | — |
| 6.3412 | 6.3417 | 116.5 | — |
| 6.3465 | 6.3491 | 117 | — |
| 6.3518 | 6.3564 | 117.5 | — |
| 6.3598 | 6.3599 | 118 | — |
| 6.3651 | 6.3671 | 118.5 | — |
| 6.3704 | 6.3741 | 119 | — |
| 6.3757 | 6.3811 | 119.5 | — |
| 6.3810 | 6.3881 | 120 | 6.35 |
| 6.3889 | 6.3910 | 120.5 | — |
| 6.3942 | 6.3978 | 121 | — |
| 6.3995 | 6.4044 | 121.5 | — |
| 6.4049 | 6.4110 | 122 | — |
| 6.4102 | 6.4175 | 122.5 | — |
| 6.4155 | 6.4239 | 123 | — |
| 6.4208 | 6.4303 | 123.5 | — |
| 6.4287 | 6.4325 | 124 | — |
| 6.4340 | 6.4386 | 124.5 | — |
| 6.4393 | 6.4447 | 125 | 6.40 |
| 6.4446 | 6.4507 | 125.5 | — |
| 6.4499 | 6.4566 | 126 | — |

Based on this data, it was discovered that the turn-on time could be controlled by generating a ramp signal and using the intersection of the ramp with the full-wave rectified AC source voltage to control the conductivity of a switch. It should be recognized that the present invention is not limited to the use of a ramp signal. Any appropriate signal can be used provided it has a substantially linearly increasing portion in the region of interest.

II. Description of the Block Diagram

In FIG. 3, a block diagram of a phase controlled regulator 20 constructed according to the teachings of the present invention which will implement the previously described theory is illustrated. The phase controlled regulator 20 is connected at input terminals 22 and 24 to an AC source voltage 26. The AC source voltage 26 is nominally 115 volts although it is known that such source voltages typically may vary from 105 to 126 volts.

The phase controlled regulator 20 is comprised of a zero crossing detector 28 which determines the zero crossings of the AC source voltage 26. A predetermined time period begins to time out at the zero crossings of the AC source voltage. After the predetermined time period has timed out, a ramp generator 32 begins to produce a reference signal 34. The reference signal 34 is representative of a periodically increasing value. The reference signal 34 illustrated in FIG. 3 is a sawtooth waveform having substantially linearly increasing ramp portions similar to the straight line approximation 16 illustrated in FIG. 1.

A sensor 36 produces a first signal 38 representative of the instantaneous value of the AC source voltage 26.

The first signal 38 and reference signal 34 are input to a comparator 40. The comparator 40 produces an output signal 42 when a predetermined relationship exists between the reference signal 34 and the first signal 38. Specifically, the output signal 42 may be generated when the magnitude of the reference signal 34 equals the magnitude of the first signal 38. In this manner, the output 42 is produced sooner when the magnitude of the AC source voltage is lower than normal and is produced later when the magnitude of the AC source voltage is higher than normal such that the effective voltage delivered to the load remains constant.

The output signal 42 is used to control the conductivity of a switch 44. The switch 44 selectively connects a load 46 to the AC source voltage 26 in response to the output signal 42. In this manner, substantially constant power is delivered to the load 46 despite fluctuations in the magnitude of the AC source voltage.

The present invention is also directed to a method for selectively connecting a load to an AC source voltage such that substantially constant RMS power is delivered to the load despite fluctuations in the magnitude of the AC source voltage and includes the steps of detecting zero crossings of the AC source voltage. A reference signal representative of a periodically increasing value is produced in response to the zero crossings of the AC source voltage. A first signal representative of the instantaneous value of the AC source voltage is produced. The reference signal is compared to the first signal. An output signal is produced in response to the existence of a predetermined relationship therebetween. The load is selectively connected to the AC source voltage in response to the output signal such that the RMS power delivered to the load remains substantially constant.

III. Description of the Electrical Schematic

In FIG. 4, an electrical schematic of the phase controlled regulator 20 shown in FIG. 3, is illustrated. In FIG. 4, components which provide the same function as those in FIG. 3 have been provided with the same reference numeral. It should be noted that although FIG. 4 illustrates an implementation of the present invention using analog components, it is known that such circuitry can also be implemented using digital techniques.

A filtering capacitor 48 is connected across input terminals 22 and 24. The function of the zero crossing detector 28 is provided by a zero-voltage switch 50 connected as illusttrated in FIG. 4. Pins 2 and 13 of the zero-voltage switch 50 are connected to the input terminal 24 through a capacitor 52. Pins 7 and 8 of the zero-voltage switch 50 are also connected to the input terminal 24. Pin 5 of the zero-voltage switch 50 is connected to the input terminal 22 through a resistor 54. The zero-voltage switch 50 produces an output pulse 56 available at pin 4 in response to the zero crossings of the AC source voltage.

The output pulse 56 is input to pin 2 of a one-shot multivibrator 58 through an optical isolator 60. Pin 2 is also connected to a positive voltage source through a resistor 61. The one shot 58 is grounded through pin 1 and is connected to a positive voltage source through pins 4 and 8. Pin 8 is also connected to ground through the series combination of a potentiometer 62 and a capacitor 64. The junction between the potentiometer 62 and capacitor 64 is connected to pins 6 and 7 of the one-shot 58.

The one-shot 58 produces an output signal 66 available at pin 3. The one shot 58 provides the function of the time delay 30 illustrated in FIG. 3. The one shot 58 begins to time out a predetermined time period in response to the pulses 56 which are representative of the zero crossings of the AC source voltage. The output signal 66 of the one-shot 58 is in a first state during the timing out of the predetermined time period and is in a second state when the predetermined time period has timed out. The resistance value of the potentiometer 62 together with the value of the capacitor 64 determines the length of the predetermined time period and hence the time during which the output signal 66 of the one-shot 58 is in the first state. The reader will recall that the length of the predetermined time period is related to the power delivered to the load. The longer the predetermined time period, the less power delivered to the load. Conversely, the shorter the predetermined time period the more power delivered to the load.

The signal 66 produced by the one-shot 58 is input to pin 6 of an electronic switch 68 and to pin 5 of the electronic switch 68 through an invertor 70. An input terminal of the invertor 70 is connected to a positive voltage source through a resistor 72 and an output terminal of the invertor 70 is connected to a positive voltage source through a resistor 74. Pins 4 and 7 of the electronic switch 68 are grounded while pin 14 is connected to a positive voltage source. Pin 8 is connected to a positive voltage source through a potentiometer 76. The function of the electronic switch 68 will be described hereinbelow in conjunction with the function of the ramp generator 32.

The ramp generator 32 is comprised of an operational amplifier 78. A first input terminal of the operational amplifier 78 is connected to pin 9 of the electronic switch 68 through a resistor 80. A second input terminal of the operational amplifier 78 is connected to ground through the series combination of a diode 82 and a resistor 84. The second input terminal of the operational amplifier 78 is connected to pin 3 of the electronic switch 68.

In operation, when the output signal 66 of the one-shot 58 is in the first state, the output terminal of the operational amplifier 78 is connected to ground through electronic switch 68 such that capacitor 86 is discharged. When the output signal 66 of the one-shot 58 changes state, the output terminal of the operational amplifier 78 is no longer grounded and the first input terminal of the operational amplifier 78 is connected to the positive voltage source through electronic switch 68 and the potentiometer 76. Because of this, the capacitor 86 begins to charge thereby producing the reference signal 34. Thus, the substantially linearly increasing portion of the reference voltage 34 is produced after a predetermined period of time has elapsed from a zero crossing of the AC source voltage. During that predetermined time, the reference signal is held at ground potential once the capacitor 86 has discharged. The slope of the substantially linearly increasing portion of the reference voltage 34 can be varied by varying the setting of the potentiometer 76. This feature allows the present invention to be applied to multi-intensity level lamp applications.

The sensor 36 is comprised of a transformer 88 having a primary winding connected across terminals 22 and 24. The secondary winding of the transformer 88 has a pair of series connected diodes 90 and 91 connected thereacross. The diodes 90 and 91 are connected together at their respective anodes. A second pair of diodes 93 and 94 are connected in parallel with the diodes 90 and 91. The diodes 93 and 94 are connected at their respective cathodes. The junction between the diodes 93 and 94 is connected to a center tap of the secondary winding through a potentiometer 96. The wiper of the potentiometer 96 is connected to ground through a resistor 98. The sensor 36 produces the first signal 38 which is a full wave rectified version of the AC source voltage. The turns ratio of the transformer 88 and the adjustment of the potentiometer 96 determine the magnitude of the first signal 38.

The reference signal 34 is input to a first input terminal of the comparator 40 through the series combination of three diodes 100, 101, 102, and a resistor 104. The first signal 38 is input to a second input terminal of the comparator 40. The comparator monitors the amplitudes of the first signal 38 and the reference signal 34 and causes the output signal 42 to change states when the magnitude of the reference signal 34 is equal to or greater than the magnitude of the first signal 38.

An output terminal of the operational amplifier 40 is connected to pin 2 of an optical isolator 106 and to a positive voltage source through a resistor 108. Pin 1 of the optical isolator 106 is connected to a positive voltage source through a resistor 110. Pin 4 of the optical isolator 106 is connected to ground. Pin 5 of the optical isolator 106 is connected to the gate terminal of a field effect transistor 112.

A power bridge 114 is connected across terminals 22 and 24. The power bridge 114 has a positive output terminal which is connected to a source terminal of the field effect transistor 112 through the series combination of a thermistor 116 and a load which in this case is a lamp filament 118. The drain terminal of the field effect transistor 112 is connected to ground. A zener diode 120 is connected across the source and drain terminals of the field effect transistor 112 to suppress transients. The field effect transistor 112 performs the function of the switch 44 illustrated in FIG. 3.

The positive output terminal of the power bridge 114 is also connected to ground through the series combination of a resistor 122 and a zener diode 124. The junction between the resistor 122 and zener diode 124 is connected to ground through a capacitor 126 and to the gate terminal of the field effect transistor 112 through a resistor 128. A negative output terminal of the power bridge 114 is connected to ground.

The configuration of the circuitry in FIG. 4 is such that when the output signal 42 available at the output terminal of the operational amplifier 40 is low, transistor 112 is nonconductive and no current flows through the thermistor 116 and lamp filament 118. However, when the output signal 42 available at the output terminal of the operational amplifier 40 changes from a low to a high state, transistor 112 becomes conductive such that current flows through thermistor 116 and lamp filament 118. The thermistor 116 is a device which has a high resistance when cold. As current flows through the thermistor 116 it warms up and the resistance drops. In this manner, the inrush of current to the lamp filament 118 is limited thus providing a "soft start" for the lamp.

As the AC source voltage varies, the amplitude of the first signal 38 changes accordingly which in turn varies the point of intersection of the first signal 38 with the reference signal 34. The result of this is to control the duty cycle of the conduction period of the field effect transistor 112.

The phase controlled regulator 20 illustrated in FIG. 4 has been constructed using the components illustrated in Table 2.

TABLE 2

| Component | Value/Part Number |
|---|---|
| Op amp 50 | RCA CA3059 |
| Capacitor 48 | .1* |
| Capacitor 52 | 47 |
| Resistor 54 | 18 K ohms |
| Opto isolator 60 | Motorola 4N26 |
| One-Shot 58 | Motorola MC1555 |
| Potentiometer 62 | 50 K ohms |
| Capacitor 64 | .1 |
| Switch 68 | Motorola MC14066B |
| Invertor 70 | Motorola MC14049UB |
| Resistors 72,74 | 10 K ohms |
| Potentiometer 76 | 1 M ohms |
| Op amp 78 | National LM 3900 |
| Resistor 80 | 100 K ohms |
| Resistor 84 | 100 K ohms |
| Capacitor 86 | .01 |
| Resistor 104 | 10 K ohms |
| Comparator 40 | National LM 339 |
| Transformer 88 | ST5-36 |
| Diode bridge 90,91,93,94 | Motorola MDA 920A3 |
| Potentiometer 96 | 1 M |
| Resistor 98 | 1 M ohms |
| Resistor 108 | 3 K ohms |
| Resistor 110 | 2.2 K ohms |
| Opto Isolator 106 | Motorola 4N32 |
| Fet 112 | IRF 242 |
| Power Bridge 114 | Motorola MDA 3506 |
| lamp 118 | 33 volt, 235 watt |
| zener diode 120 | 171 volt |
| resistor 122 | 1.5 K ohms |
| zener diode 124 | 16 volt |
| capacitor 126 | 100 |
| resistor 128 | 820 ohms |

*All capacitor values are in microfarads.

The variations of the turn-on time with the AC source voltage obtained using the circuit constructed with the components illustrated in Table 2 are shown in column four (Experimental Results) of Table 1. As can be seen, these values agree very well with the straight line approximation values.

The phase controlled regulator 20 illustrated in FIG. 4 and constructed using the components identified in Table 2 was used to regulate a 33 volt lamp. A Staco variable transformer was used to vary the AC source voltage. A IL10A research photometer was used measure lamp intensity. The results of these test are shown in Table 3. All lamp intensities were measured in foot candles.

TABLE 3

| VAC | Small Pattern | Large Pattern |
|---|---|---|
| | Single Filament Lamp | |
| 105 | 5480 | 2800 |
| 110 | 5610 | 2980 |
| 115 | 5780 | 3000 |
| 120 | 5620 | 2870 |
| 126 | 5160 | 2720 |
| | Dual Filament Lamp | |
| 105 | 5800 | 4440 |
| 110 | 5980 | 4590 |
| 115 | 6020 | 4680 |
| 120 | 5890 | 4640 |
| 126 | 5380 | 4350 |

The decrease in lamp intensity at voltages either above or below nominal line voltage of 115 volts may be attributed to the inability of the transformer to source the large instantaneous power demands the lamp requires at turn-on. This problem may be alleviated if the positive slope portion of the wave-form is used or, as has been suggested, if the circuit is used to regulate the primary voltage on a step-down transformer. Initial testing has indicated that regulation of a transformer primary is feasible.

While the present invention has been described in connection with an exemplary embodiment thereof, it will be understood that many modifications and variations will be readily apparent to those of ordinary skill in the art. This disclosure and the following claims are intended to cover those modifications and variations.

What is claimed is:

1. A phase controlled regulator for selectively connecting a load to an AC source voltage such that substantially constant power is delivered to the load despite fluctuations in the magnitude of the source voltage, said regulator comprising:

means for detecting the zero crossings of the AC source voltage;

means for timing out a predetermined time period in response to the zero crossings of the AC source voltage;

means for producing a reference signal representative of a periodically increasing value in response to the timing out of said predetermined time period;

means for producing a first signal representative of the instantaneous value of the AC source voltage;

means for comparing said reference signal with said first signal for producing an output signal when a predetermined relationship exists therebetween; and switch means responsive to said output signal for selectively connecting the load to the AC source voltage.

2. The regulator of claim 1 wherein said predetermined relationship includes the magnitude of said reference signal equaling the magnitude of said first signal.

3. The regulator of claim 2 wherein said reference signal includes a sawtooth waveform having substantially linearly increasing ramp portions such that said output signal is produced sooner when the magnitude of the AC source voltage is lower than normal and is produced later when the magnitude of the AC source voltage is higher than normal.

4. The regulator of claim 1 wherein said means for producing a reference signal includes a ramp generator.

5. The regulator of claim 1 additionally comprising means for changing the length of said predetermined time period thereby changing the amount of power delivered to the load.

6. The regulator of claim 1 wherein said means for timing out a predetermined time period includes a one-shot multivibrator for producing a logic signal in response to the zero crossings of said AC source voltage, said logic signal being in a first state during said predetermined time period and being in a second state after said predetermined time period has timed out.

7. The regulator of claim 6 wherein said ramp generator produces a substantially linearly increasing reference signal when said logic signal is in said second state and is reset when said logic signal is in said first state.

8. The regulator of claim 7 additionally comprising means for changing the slope of said substantially linearly increasing reference signal.

9. The regulator of claim 1 wherein said means for producing said first signal includes a transformer and a rectifier responsive to said transformer.

10. The regulator of claim 1 wherein said means for comparing includes an operational amplifier for receiving said first signal at a first input terminal thereof and said reference signal at a second input terminal thereof, said output signal being available at an output terminal of said operational amplifier.

11. The regulator of claim 1 wherein said switch means includes a field effect transistor having a gate terminal responsive to said output signal.

12. The regulator of claim 1 additionally comprising an element having a high cold resistance, and wherein the load includes a light connected to the AC source voltage through said element.

13. The regulator of claim 12 wherein said element includes a thermistor.

14. A phase controlled regulator for selectively connecting a lighting load to an AC source voltage such that substantially constant RMS power is delivered to the load despite fluctuations in the magnitude of the source voltage, said regulator comprising:

means for detecting the zero crossing of the AC source voltage;

means for producing a periodic substantially linearly increasing ramp voltage in response to the zero crossings of the AC source voltage;

means for delaying the production of said periodic substantially linearly increasing ramp voltage until a predetermined period of time elapses after a zero crossing of the AC source voltage, said delay being related to the amount of RMS power to be delivered to the load means for producing a first signal representative of the instantaneous magnitude of the AC source voltage;

means for comparing said ramp voltage with said first signal and for producing an output signal when a predetermined relationship exists therebetween such that said output signal is produced sooner when the AC source voltage is lower than normal and later when the AC source voltage is higher than normal; and switch means responsive to said output signal for selectively connecting the load to the AC source voltage such that the RMS power delivered to the load remains substantially constant.

15. The regulator of claim 14 additionally comprising a first optical isolator connected between said means for detecting the zero crossings and said means for delaying, and a second optical isolator connected between said means for comparing and said switch means.

16. The regulator of claim 14 additionally comprising a temperature dependent resistance for limiting the initial inrush of current to the lighting load.

17. A method of selectively connecting a load to an AC source voltage such that substantially constant RMS power is delivered to the load despite fluctuations in the magnitude of the source voltage, said method comprising the steps of:

detecting the zero crossing of the AC source voltage;

producing a reference signal representative of a periodically increasing value in response to the zero crossings of the AC source voltage;

delaying the production of said reference signal for a predetermined period of time measured from each zero crossing, and wherein the amount of RMS power delivered to the load is related to the duration of said predetermined period of time;

producing a first signal representative of the instantaneous value of the AC source voltage;

comparing said reference signal to said first signal;

producing an output signal in response to the existence of a predetermined relationship therebetween; and selectively connecting the load to the AC source voltage in response to said output signal such that the RMS power delivered to the load remains substantially constant.

18. The method of claim 17 additionally comprising the step of changing said duration of said predetermined period of time.

* * * * *

UNITED STATES PATENT AND TRADEMARK OFFICE

CERTIFICATE OF CORRECTION

PATENT NO. : 4,689,548

DATED : August 25, 1987

INVENTOR(S) : Douglas M. Mechlenburg

It is certified that error appears in the above—identified patent and that said Letters Patent is hereby corrected as shown below:

Col. 3, line 65, after "turn-on" delete "times, it" and substitute therefor --time t1--.

Col. 5, line 6, after "26." delete "A" and substitute therefor --A predetermined time period is timed out by a time delay circuit 30. The--.

Col. 5, line 25, after "output" insert --signal--.

Col. 5, line 65, delete "illusttrated" and substitute therefor --illustrated--.

Col. 6, line 56, after "to" insert --an output terminal thereof through a capacitor 86. The output terminal of the operational amplifier 78 is connected to--.

Col. 8, line 67, delete "test" and substitute therefor --tests--.

Signed and Sealed this

Tenth Day of May, 1988

*Attest:*

*Attesting Officer*

DONALD J. QUIGG

*Commissioner of Patents and Trademarks*